US006126190A

United States Patent [19]

Viodet

[11] Patent Number: 6,126,190

[45] Date of Patent: Oct. 3, 2000

[54] REMOVABLE STOP FOR A SKI BINDING RECEIVING CHANNEL

[75] Inventor: Patrice Viodet, Thiernay, France

[73] Assignee: Look Fixations, SA, Nevers, France

[21] Appl. No.: 09/387,544

[22] Filed: Aug. 31, 1999

[30] Foreign Application Priority Data

Sep. 1, 1998 [FR] France ..... 98 11049

[51] Int. Cl.[7] ..... A63C 9/00

[52] U.S. Cl. ..... 280/633; 280/634; 280/636; 280/618

[58] Field of Search ..... 280/633, 634, 280/607, 618, 636, 617

[56] References Cited

U.S. PATENT DOCUMENTS

| | | | |
|---|---|---|---|
| 3,623,445 | 11/1971 | Holmes | 114/204 |
| 5,114,172 | 5/1992 | Rousset et al. | 280/633 |
| 5,199,736 | 4/1993 | Jungkind | 280/618 |
| 5,318,321 | 6/1994 | Dogat et al. | 280/633 |
| 5,413,373 | 5/1995 | Evans et al. | 280/620 |
| 5,560,633 | 10/1996 | McGowan | 280/614 |

FOREIGN PATENT DOCUMENTS

| | | |
|---|---|---|
| 548468 A1 | of 0000 | European Pat. Off. . |
| 2614545 | of 0000 | France . |
| 2664504 | of 0000 | France . |
| 9213609 U | of 0000 | Germany . |

*Primary Examiner*—Christopher P. Ellis
*Assistant Examiner*—Rashmi Sharma
*Attorney, Agent, or Firm*—Fay, Sharpe, Fagan, Minnich & McKee, LLP

[57] ABSTRACT

An assembly for retaining a ski boot on a ski, snowboard, monoski, or the like includes a rear binding portion (1), such as a step-in rear binding. The rear binding portion (1) is supported on a body (2) having wings (10*a*, 10*b*) which are slidably received in a slide channel (7). The slide channel has slide surfaces (8*a*, 8*b*) which permit the binding body to slide longitudinally and overhanging edges (9*a*, 9*b*) which prevent the binding body from being lifted out of the channel. A rear piece (14) is removably mounted at the rear end of the channel such that a stop or abutment (11) limits rearward movement of the binding body (2). To facilitate cleaning and storage, a projection (17) on a resilient tongue (18) of the rear end piece (14) is depressed to disengage the rear end piece from an intermediate piece (13) to which the slide channel is mounted. Disengaging the rear end piece (14) permits it to be removed, which, in turn, permits the binding portion to be slid out of the end of the channel and removed.

11 Claims, 7 Drawing Sheets

REMOVABLE STOP FOR A SKI BINDING RECEIVING CHANNEL

BACKGROUND OF THE INVENTION

The present invention relates to devices for retaining a boot on snow equipment, such as skis, monoskis, snowboards, or the like. In the ski field, such devices are generally known as ski bindings.

The present application concerns more particularly a system of support for limiting displacement near the rear part of the binding.

In general, the skier's boot is retained in the ski in a releasable fashion in the front part by a toe binding or portion and in the rear part by a heel binding or portion. In cases of significant force, the boot is released from the ski before the limb or joints of the skier are injured by releasing the toe, the heel, or both. To this effect, the toe binding portion, for example, includes a mechanism that pivots laterally around a vertical axis while the heel binding portion generally includes a mechanism that pivots upward about a horizontal axis. The heel and toe binding mechanisms are adjustable so that the skier can select the amount of force that is necessary to free the boot from the ski.

There are already a large number of bindings that have means for regulating their longitudinal position on the ski. Also, toe and heel binding portions are already known that are adjustable in position along the ski to adapt the distance between the toe and the heel to the length of the sole of the boot. As a general rule, it is the heel binding that is displaced by having a body portion which is slid along a groove and immobilized in the chosen longitudinal position by a lock or pin. The lock is typically movable between two positions, a locking position, and an unlocked position which permits the user to displace the binding along the longitudinal axis of the ski to a determined longitudinal position, adapting it to the length of the sole of the shoe.

One advantage of the present invention is that it facilitates cleaning and maintenance of bindings.

Another advantage is that it facilitates the storage of skis and equipment.

Still other characteristics and advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
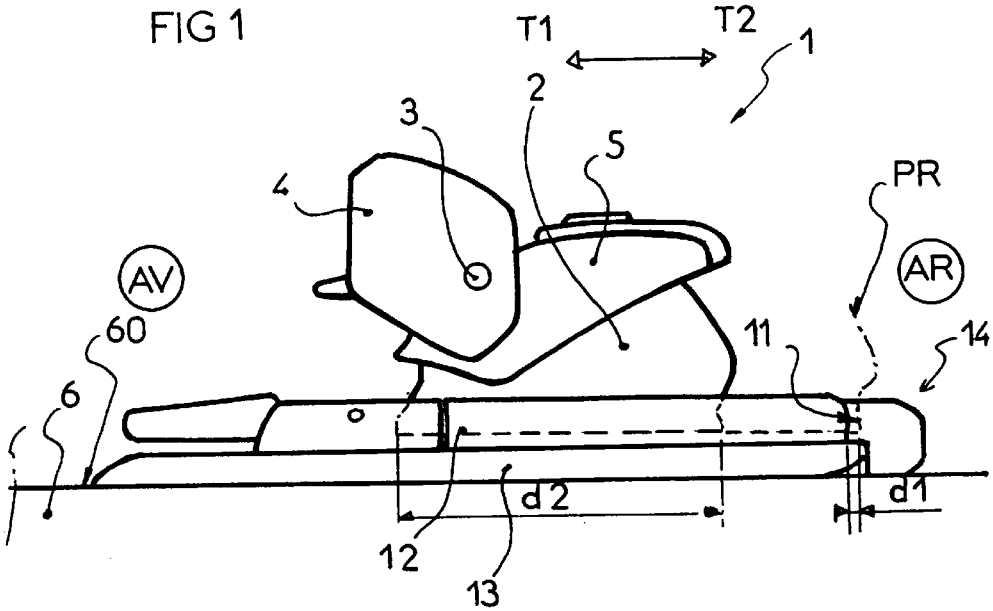
FIG. 1 is a lateral view of a mechanism for retaining a boot on a ski in accordance with the present invention.
Figure 2:
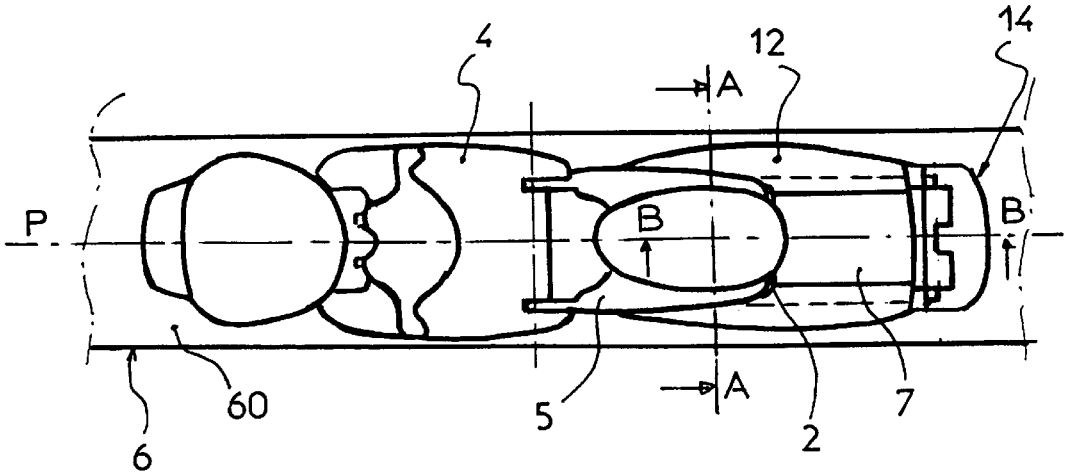
FIG. 2 is a top view of the mechanism of FIG. 1.
Figure 3:
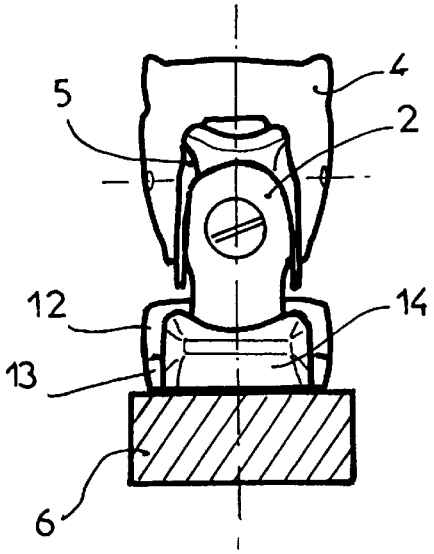
FIG. 3 is a rear view of the mechanism of FIG. 1.
Figure 4:
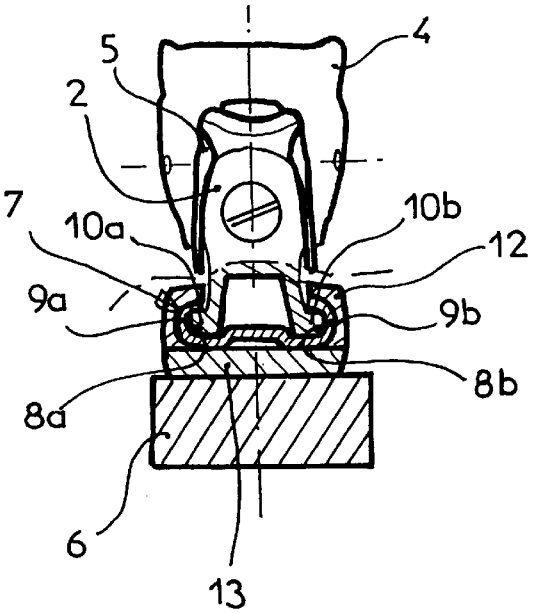
FIG. 4 is a view in partial section along section A—A of FIG. 2.
Figure 5:
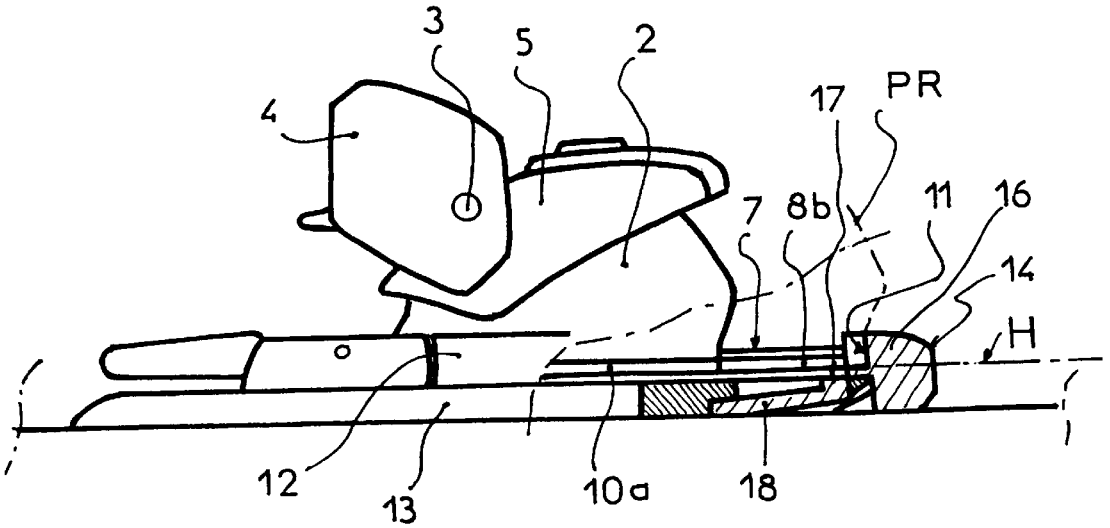
FIG. 5 is a lateral view in partial section along section B—B of FIG. 2.
Figure 6:
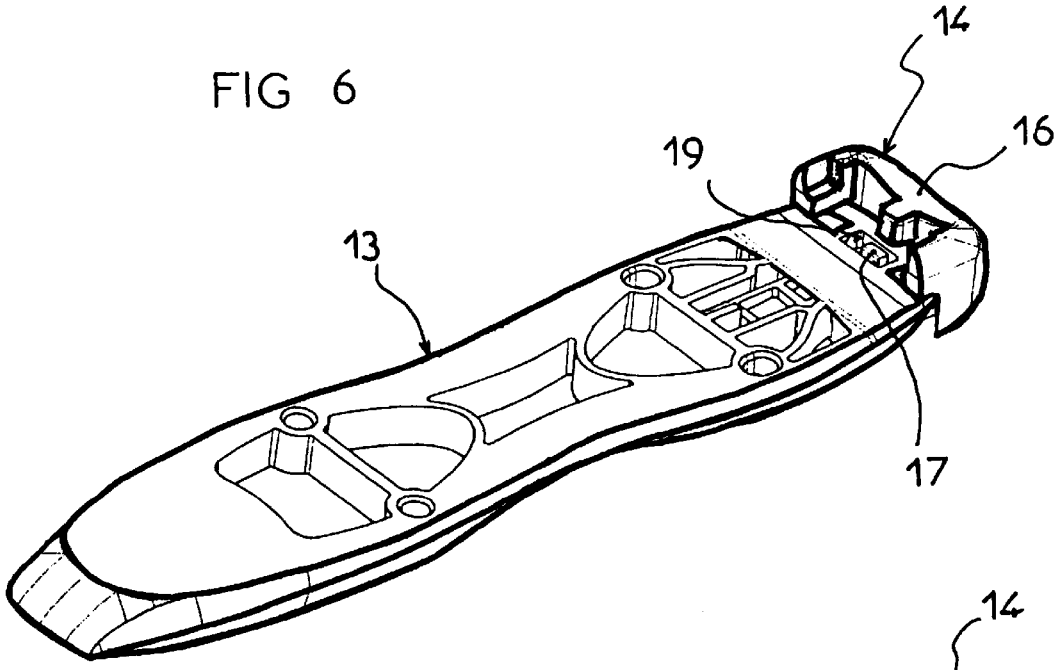
FIG. 6 is a perspective view illustrating an interface piece with a rear piece mounted.

The illustrated binding is exemplary of contemplated equipment for supporting the rear or boot heel retaining portion of a binding. This binding, for example, includes a rear or boot heel retaining mechanism 1 of the illustrated "step-in" type. The rear binding includes a body 2 that is symmetric about a vertical plane of symmetry P. A pivoting retention mechanism 4 which pivots about a transverse axle 3 and a pivotal release lever 5 are articulated on the body part 2. Details of the mechanism for pivoting the heel engaging retention member 4 on the body 2 between a retaining position for retaining the heel of the boot and a heel releasing position are known. The retention mechanism 4 is biased in the position for retaining the heel of the boot by the action of a spring system which includes a movable element that is biased into a releasable locking arrangement with a series of steps or grooves in the interior of the mechanism. The release lever 5 permits the user to free the boot by pivotal movement of the mechanism to move the retainer 4 between the retaining and releasing positions.

The heel binding body 2 is mounted for longitudinal translation back and forth T1, T2 along the ski 6. To this end, the body 2 is slidably mounted in a slide track or channel 7 fixed to the ski. The slide is defined, in the preferred embodiment, by a sheet metal channel which extends longitudinally and defines two slide surfaces 8*a*, 8*b* extending longitudinally. The sheet metal is rolled along its longitudinal edges 9*a*, 9*b* to define overhanging side rails. The rear binding body 2 has a pair of lateral wings or edges 10*a*, 10*b* whose lower surface engages and slides along the slide surfaces 8*a*, 8*b* of the slide channel 7 and which extend under the side edges 9*a*, 9*b*. In this manner, the body is retained against upward movement but is permitted to be displaced longitudinally for and aft T1, T2.

Moreover, a locking means is provided for permitting the user to lock the binding body 2 in a predetermined longitudinal position along the slide channel 7. For example, the locking means may include a movable pin or locking element which cooperates with the slide channel or track. To this end, a central part of the locking means preferably includes a succession of lateral teeth while the horizontal face of the slide includes a corresponding succession of teeth or detents.

The binding body 2 can therefore be translated longitudinally along the slide channel 7 toward the front AV in direction T1 and toward the rear AR along direction T2 until a rear portion PR engages an abutment or stop 11 at the rear of the slide channel 7. The abutment 11 prevents the body 2 from being displaced longitudinally out of the rear AR of the channel 7.

The stop or abutment 11 which limits rearward displacement is removable and can be removed to permit the body to be displaced rearward past the rearmost position PR and be removed from the rear of the slide channel 7.

In the preferred mode of operation illustrated in FIGS. 1–18, a housing 12 covers the slide channel 7 for improved aesthetics. Under the slide channel and housing assembly and above an upper surface 60 of the ski 6, an intermediate or interface piece 13 is disposed. A rear end piece 14 which carries the stop or abutment 11 is removably fixed to the interface piece 13.

The end piece 14 includes a linking and locking element 15 which is engaged under a rear part of the interface piece 13. The linking and locking element 15 functions as a guide and lock, and provides an embodiment of the locking means discussed above. The linking and locking element 15 is, connected preferably integral with an upward extending, projecting portion 16 which extends to the height of and integrally forms the abutment or stop 11 for the binding body 2.

As before, the end piece 14 is mounted in a removable fashion such that it can be removed, if desired, from the interface piece 13. To this end, the end piece 14 is fixed to the interface piece 13 by a locking or connecting means which includes a movable, resilient locking element, particularly a projection 17 disposed at a free end of a resilient tongue 18. The resilient tongue 18 which is resiliently deformable and carries the projection 17 is preferably a unitary construction with the end piece 17. Preferably, this unitary construction of the rear mounting piece is constructed of a plastic material. The resilient tongue 18 extends towards the rear along a longitudinal axis such that the projection 17 cooperates with a corresponding locking hole 19 defined at a rear end of the interface piece 13.

More precisely, the linking and locking element 15 of the rear piece 14 includes two lateral grooves or slots 20*a*, 20*b* which cooperate with two longitudinal profiles 21*a*, 21*b* defined at the end of the interface piece 13 that define a lower opening 22 which receives the above-discussed linking and locking element 15.

Of course, the upward projecting portion 16 that forms the stop is disposed in a displacement zone Z toward the rear of the binding body 2 at a distance d1 from the rear of the channel 7. The distance d1 is less than a length d2 of the sliding surface or projections 10*a*, 10*b* of the binding body. The locking projection 18 is not in this trajectory, but is below a lower plane H of the binding body 2.

When the rear piece 14 is in place as illustrated in FIGS. 1, 2, 6, and 17, it is fixed to the intermediate piece 13 and the stop 11 is disposed in the displacement zone near the rear of the binding body and prevents the body from being slid out of the glide track 7. The binding body 2 is not permitted to exit the glide track 7.

Figure 15:
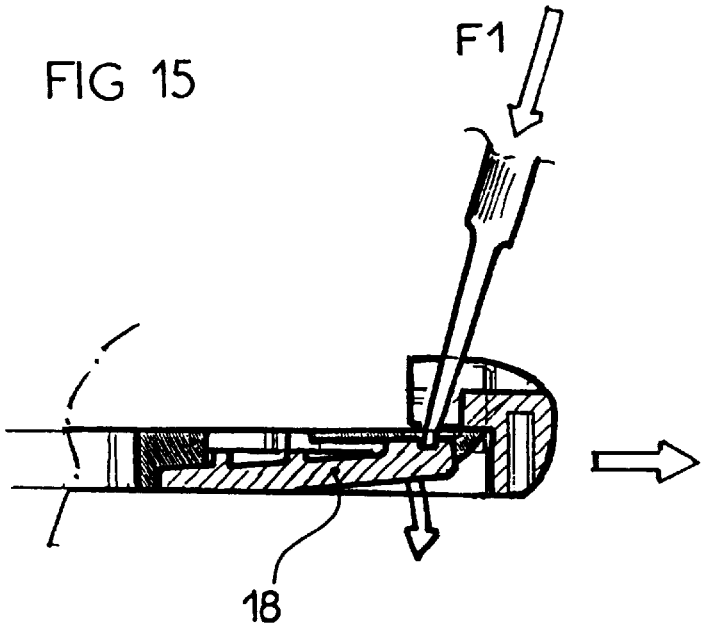
FIGS. 15 and 16 are longitudinal views in partial section illustrating release of the rear piece; and, FIGS. 17 and 18 are side, longitudinal views which show how the heel or rear clamping element is retained and released by the rear piece.

By applying a mechanical force in a direction F1 with a mechanical element to the locking projection 17 as illustrated in FIG. 15, the user is able to disengage and remove the rear piece 14 and also draw back the stop 11.

Figure 7:
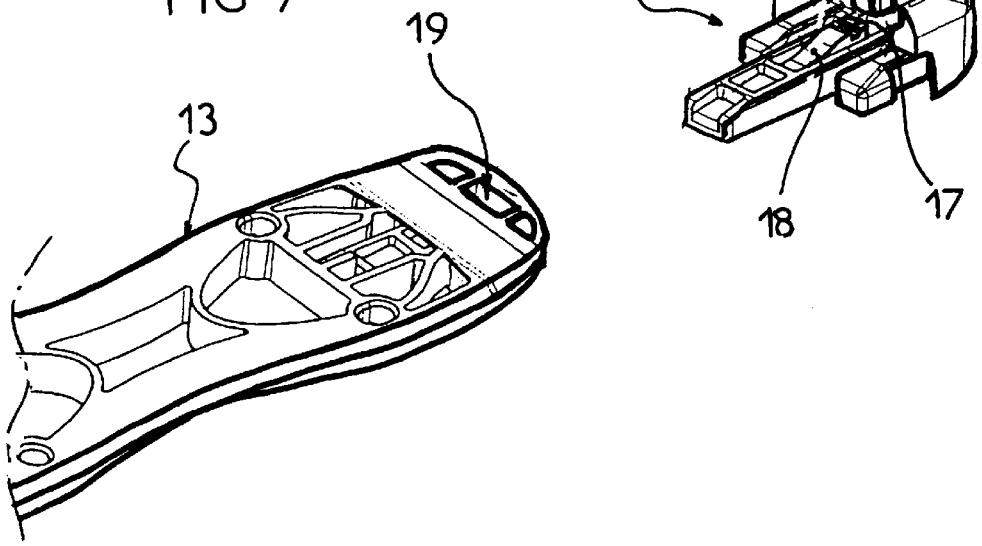
FIG. 7 is an expanded view analogous to FIG. 6 with the rear piece detached.
Figure 8:
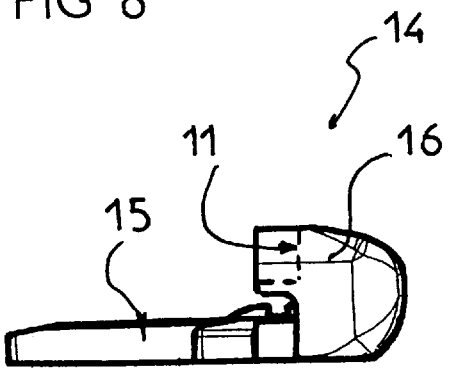
FIG. 8 is a lateral side view of the rear piece of FIG. 7.
Figure 9:
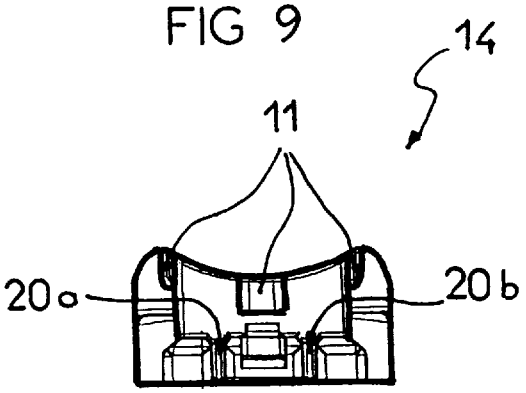
FIG. 9 is a front view of the rear piece.
Figure 10:
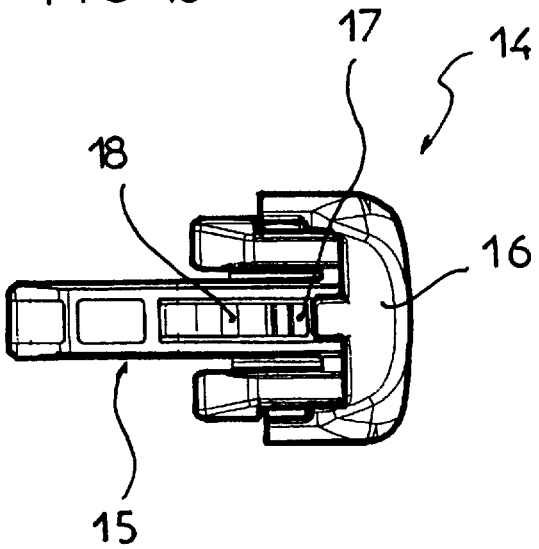
FIG. 10 is a top view of the rear piece.
Figure 11:
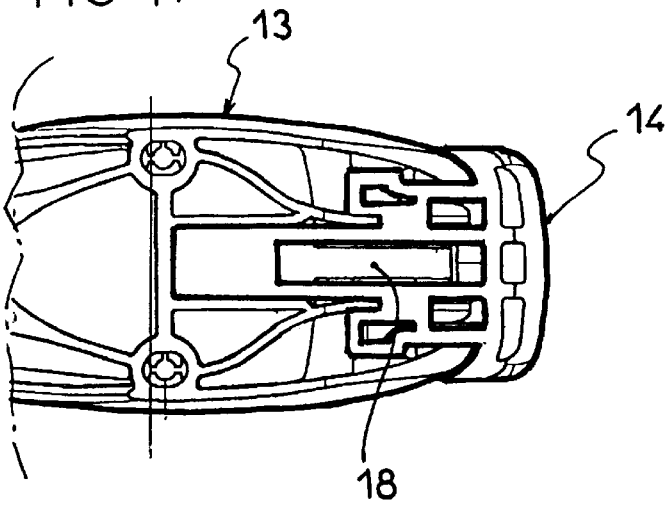
FIG. 11 is a bottom view of a rear portion of the interface piece of FIG. 6 with the rear piece attached.
Figure 12:
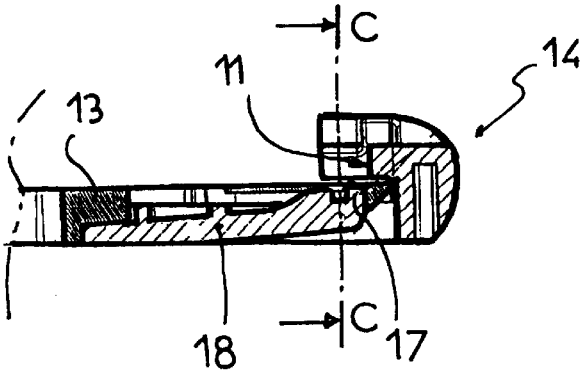
FIG. 12 is a longitudinal view in partial section of the rear portion of the interface piece with the rear piece attached.
Figure 13:
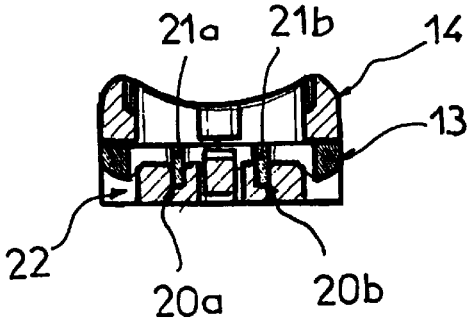
FIG. 13 is a transverse sectional view along section C—C of FIG. 12.
Figure 14:
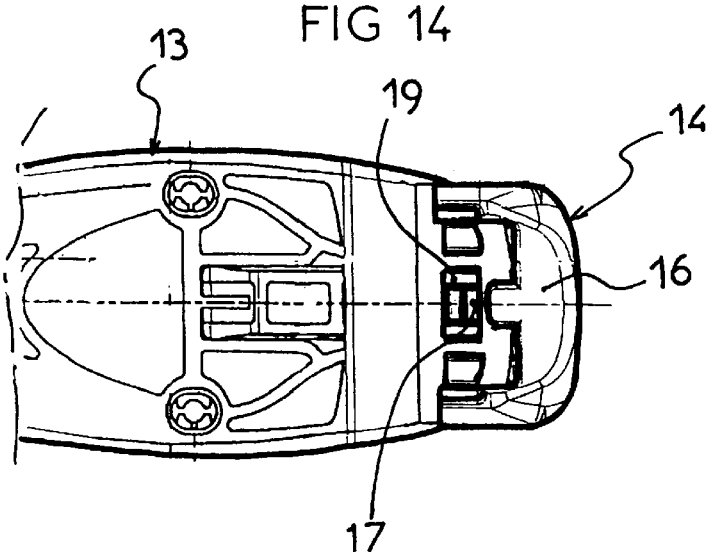
FIG. 14 is a top view of the rear portion of the interface piece with the rear piece attached.
Figure 16:
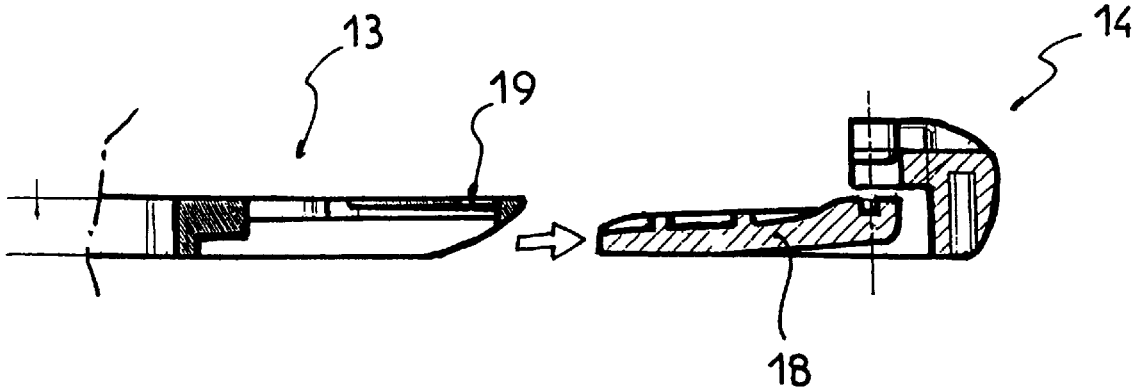
Figure 17:
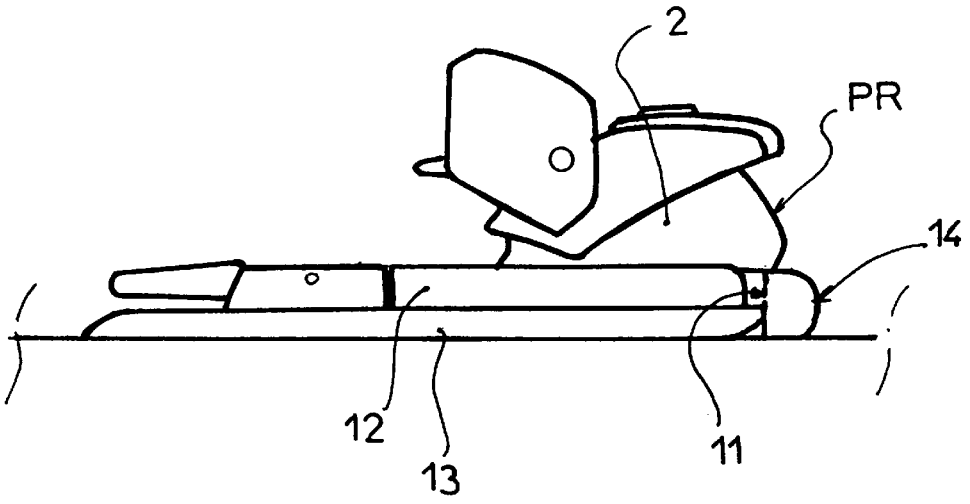
Figure 18:
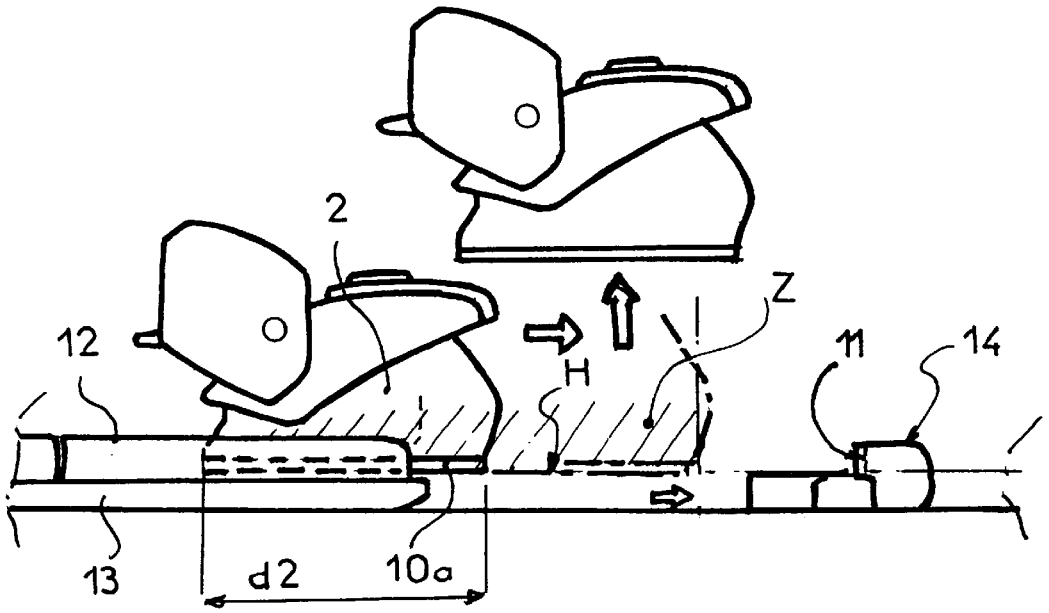

When the rear piece is withdrawn to the rear as illustrated in FIGS. 7, 16, and 18, the binding body 2 can slide to the rear past the rear stop position PR and totally exit the slide to be completely disengaged. Notably, this permits cleaning the binding and facilitates storage of the skis.

As illustrated, the end piece is removably mounted to the intermediate piece 13 below the slide track 7. However, it is to be appreciated that the end piece 14 can also be mounted to the slide track itself, to the housing 12, or to another structure that supports the ski binding.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An assembly for retaining a boot on a ski, the assembly comprising:

a retaining mechanism which engages and retains the boot;

a body on which the retaining mechanism is mounted;

a longitudinal slide channel within which the body is slidably mounted, the slide channel being fixed to the ski;

an intermediate piece connected with the slide channel and the ski;

a stop which prevents the body from longitudinally exiting a rear of the slide channel, characterized by the stop being a part of a rear piece, the rear piece being removably connected to the intermediate piece.

2. The assembly for retaining a boot on a ski as set forth in claim 1 further including a locking means for releasably locking the rear piece to the intermediate piece.

3. An assembly for retaining a boot on a ski, the assembly comprising:

a retaining mechanism which retains the boot;

a body on which the retaining mechanism is mounted;

a longitudinal slide channel within which the body is slidably mounted, the slide channel being fixed to the ski;

an intermediate piece connected with the slide channel and the ski;

a removable rear piece removably connected to the intermediate piece;

a stop which prevents the body from longitudinally exiting the slide channel, the stop being a part of the rear piece;

a movable locking element which releasably locks the rear piece to the intermediate piece, the movable locking element cooperating with a locking groove defined in the intermediate piece.

4. The assembly for retaining a boot on a ski as set forth in claim 3 wherein the movable locking element includes a projection disposed on an end of a resilient tongue.

5. The assembly for retaining a boot on a ski as set forth in claim 1 wherein the intermediate piece is disposed below the slide channel and the rear piece extends to the rear of the slide channel.

6. The assembly for retaining a boot on a ski as set forth in claim 1 wherein the rear piece includes an upward extending portion which defines the stop, the upward projecting portion being disposed in the displacement zone of the body within the slide channel.

7. An assembly for retaining a boot on a ski, the assembly comprising:

a retaining mechanism which retains the boot;

a body on which the retaining mechanism is mounted;

a longitudinal slide channel within which the body is slidably mounted, the slide channel being fixed to the ski;

an intermediate piece connected with the slide channel and the ski;

a rear piece removably connected to the intermediate piece, the rear piece including an extending base portion which is engaged below a rear portion of the intermediate piece and releasably locked thereto; and a stop defined by an extending portion of the rear piece which prevents the body from longitudinally exiting the slide channel.

8. A binding assembly comprising:

an intermediate piece which is mounted to an upper surface of a ski;

a slide channel which defines a lower sliding surface and inwardly curled, overhanging side edges to define a slide path extending longitudinally along the ski;

a releasable binding portion having a sliding surface which engages the sliding surface of the slide channel and extending portions disposed below the overhanging edges of the slide channel such that the binding portion is slidable longitudinally along the slide channel and removable only from a rear end of the slide channel;

a separate, end piece slidably disposed in the slide channel and including an integral locking mechanism which is selectively lockable to the intermediate piece to lock the end piece against sliding movement during skiing, the end piece including a stop surface which is disposed adjacent the rear end of the slide channel to block the binding portion from being slid out of and removed from the slide channel when the end piece is connected to the intermediate piece.

9. The assembly for retaining a boot on a ski as set forth in claim 6 in which the rear piece includes an extended base portion which is engaged below a rear portion of the intermediate piece and locked thereto by a locking means.

10. The assembly for retaining a boot on a ski as set forth in claim 1 in which the end piece is removably connected to the slide channel itself.

11. The assembly for retaining a boot on a ski as set forth in claim 1 in which the end piece is removably connected to a housing that is attached to and covers the slide channel.

* * * * *